US008109313B2

(12) United States Patent
Rosso et al.

(10) Patent No.: US 8,109,313 B2
(45) Date of Patent: Feb. 7, 2012

(54) CORNER BEAD ROLLER TOOL

(75) Inventors: Aaron Charles Rosso, Chicago, IL (US); Matthew Earle Myers, Naperville, IL (US); Amar Arvind Patel, South Barrington, IL (US); Scott Fong, Causeway Bay (HK); Joseph Z. Wascow, Mundelein, IL (US); Daniel J. Williams, Chicago, IL (US); Brian A. Retzke, Downers Grove, IL (US)

(73) Assignee: United States Gypsum Company, Chicago, IL (US)

( * ) Notice: Subject to any disclaimer, the term of this patent is extended or adjusted under 35 U.S.C. 154(b) by 924 days.

(21) Appl. No.: 11/868,188

(22) Filed: Oct. 5, 2007

(65) Prior Publication Data

US 2009/0090471 A1 Apr. 9, 2009

(51) Int. Cl.
*B30B 3/00* (2006.01)
*B30B 7/00* (2006.01)

(52) U.S. Cl. ..... 156/574; 156/579

(58) Field of Classification Search ..... 156/574, 156/577, 579

See application file for complete search history.

(56) References Cited

U.S. PATENT DOCUMENTS

| | | | | |
|---|---|---|---|---|
| 2,533,209 | A | 12/1950 | Ames | |
| 2,824,328 | A * | 2/1958 | Bedford | 15/230.11 |
| 4,197,624 | A | 4/1980 | Lass | |
| 4,890,967 | A * | 1/1990 | Rosenbaum | 411/377 |
| 5,203,954 | A | 4/1993 | Moore | |
| 5,226,809 | A * | 7/1993 | Franco | 24/704.1 |
| 6,012,889 | A * | 1/2000 | Robbins et al. | 411/372.6 |
| 6,450,232 | B1 | 9/2002 | Smythe, Jr. | |
| 6,957,470 | B2 | 10/2005 | Rivadeneira | |
| 2004/0061373 | A1 | 4/2004 | McPherson et al. | |

* cited by examiner

*Primary Examiner* — Mark A Osele
(74) *Attorney, Agent, or Firm* — Greer, Burns & Crain, Ltd.; Pradip Sahu; Philip T. Petti

(57) ABSTRACT

A wallboard finishing roller having an elongated bracket with two ends is provided. Two roller assemblies are attached to the bracket such that the first roller assembly includes a center axis that is perpendicular to a center axis of the second roller assembly. Each roller assembly includes a wheel, a bushing and a shaft such that the wheel is rotatable around the axis of the shaft. The roller assembly is affixed to the bracket by a bracket nut, which is held in place by a bumper.

14 Claims, 5 Drawing Sheets

CORNER BEAD ROLLER TOOL

BACKGROUND OF THE INVENTION

The present invention relates generally to wallboard finishing tools, and more specifically to corner bead roller tools for use in generally finishing corners of wallboard.

Corner bead products offer a thin layer of protection over the easily damaged edges of wallboard panels. The corner bead category is divided into four main segments: bare metal (nail-on), vinyl (conventional and flex roll), paper-faced bead metal and paper-faced bead plastic. A corner bead roller tool is used to accurately align the tape-on bead and squeeze out excess settable wallboard compound with greater ease and efficiency.

In use, a first piece of wallboard is mounted and a second piece of wallboard is mounted such that an end of the first piece abuts adjacently to an end of the second piece of wallboard to form a corner. The user will then apply wallboard compound to the corner of the wallboard in preparation of the finishing. The next step is to cover the wallboard compound with tape to form a corner of wallboard. To properly finish the corner and edge of the wallboard, the corner and tape must be pressed firmly along the corner seam of the wallboard to remove any excess wallboard compound and at the same time press the tape firmly against the wallboard to ensure a desirable finish.

BRIEF SUMMARY OF THE INVENTION

The present corner bead tool includes a bumper that extends beyond the tool bracket in order to prevent accidental damage to a wall during use. The bumper also holds a bracket nut in place such that the bracket nut is non-rotatable. A shaft rotatably attaches a roller/wheel to the bracket engaging the bracket nut without requiring an external force to hold the bracket nut during tightening. In addition, the corner bead tool provides that the shaft head is at least partially exposed from the wheel of the roller assembly to facilitate access for roller/wheel replacement. Also, the roller assembly includes wheels that have a dual taper that also allows the wheels to provide better traction against the wallboard and to facilitate removing excess wallboard compound from the corner. The wheels are connected to a bushing using a tongue-in-groove connection, which prevents longitudinal movement of the wheel with respect to the bushing and holds the wheel in place to prevent "slipping."

In one embodiment, and to facilitate the finishing of wallboard, the present corner bead tool provides an elongated bracket having two ends. Each end of the elongated bracket includes a first roller assembly and a second roller assembly such that the first roller assembly includes a center axis that is perpendicular to a center axis of the second roller assembly. Each of the roller assemblies includes a wheel that is mounted to a bushing. The bushing in turn is rotatably mounted to a shaft that is connectable to the elongated bracket. The shaft is connected to the bracket utilizing a bracket nut. A bumper associated with the bracket is also included and is configured to non-rotatably capture the bracket nut.

In another embodiment, and to facilitate the finishing of wallboard, the present corner bead tool provides an elongated bracket having two ends. Each end of the elongated bracket includes a first roller assembly and a second roller assembly such that the first roller assembly includes a center axis that is perpendicular to a center axis of the second roller assembly. Each of the roller assemblies includes a wheel that is mounted to a bushing. The bushing is in turn rotatably mounted to a shaft that is connectable to the elongated bracket. A bumper is also included and includes a contact end surface and a portion of the bumper that extends beyond the length of the elongated bracket such that the bumper protects a wall from damage that is potentially caused by the bracket.

In yet another embodiment, and to facilitate the finishing of wallboard, the present corner bead tool provides an elongated bracket having two ends. Each end of the elongated bracket includes a first roller assembly and a second roller assembly such that the first roller assembly includes a center axis that is perpendicular to a center axis of the second roller assembly. Each of the roller assemblies includes a wheel that is mounted to a bushing. The bushing is rotatably mounted to a shaft that is connectable to the elongated bracket. Each wheel of each roller assembly includes a dual taper, a traction portion and a tapered end portion. The traction portion of the end of the roller assembly furthest from the bracket has less of a taper than does the tapered end of the roller assembly closest to the bracket.

In a further embodiment, and to facilitate the finishing of wallboard, the present corner bead tool provides an elongated bracket having two ends. Each end of the elongated bracket includes a first roller assembly and a second roller assembly such that the first roller assembly includes a center axis that is perpendicular to a center axis of the second roller assembly. Each of the roller assemblies includes a wheel that is mounted to a bushing. The bushing is rotatably mounted to a shaft that is connectable to the elongated bracket. Each wheel is mounted to each bushing utilizing a tongue and groove connection.

DETAILED DESCRIPTION OF THE INVENTION

Figure 1:
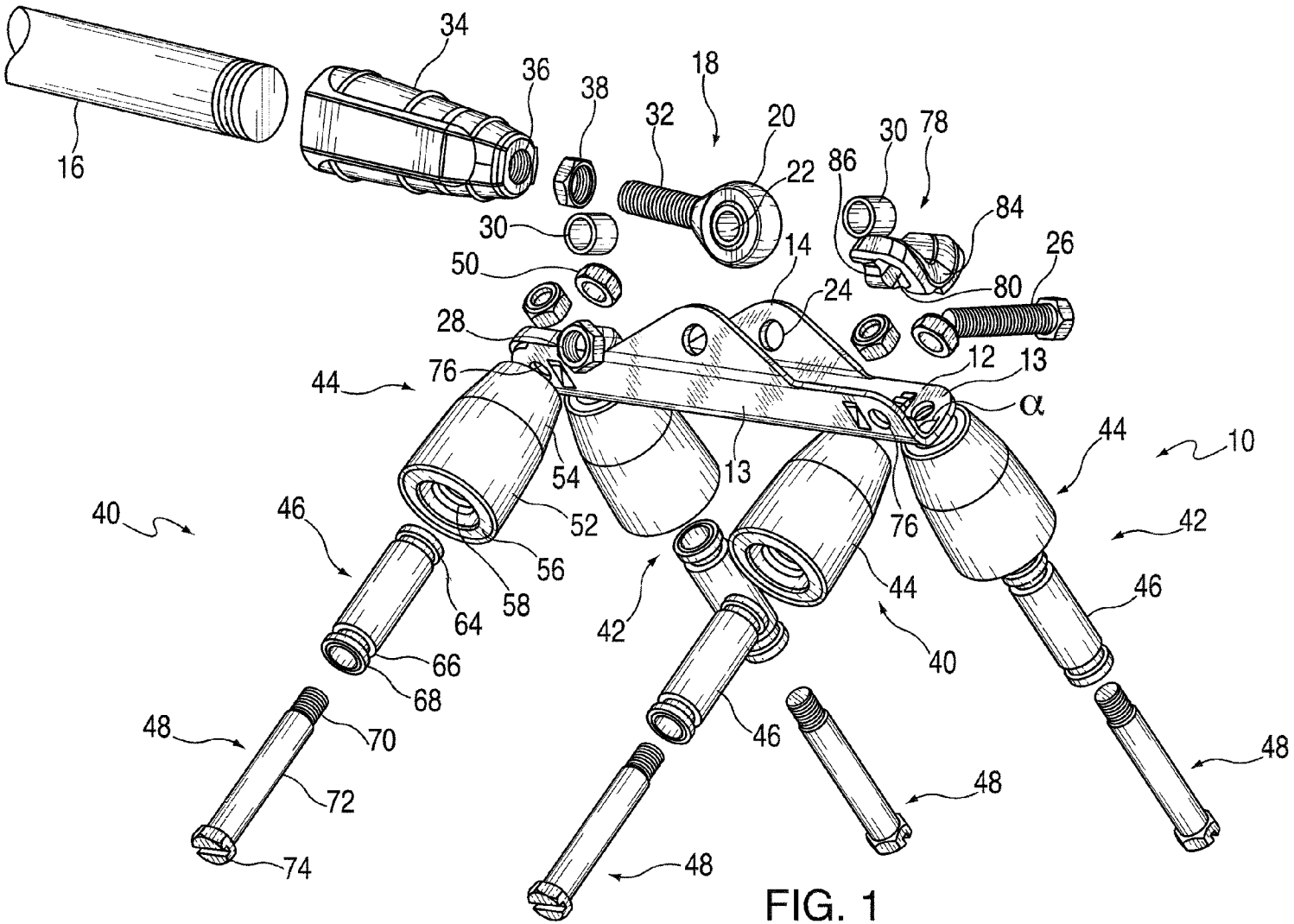
FIG. 1 is an exploded perspective view of an embodiment of the present corner bead roller.

As seen in FIG. 1, a corner bead tool 10 in accordance with the present invention includes an elongated bracket 12. The bracket 12 is preferably elongated and symmetrical on each end, although it is contemplated that in certain uses it may be desirable for the bracket to not be symmetrical (for example, in custom drywall corner instances). It is preferred that the bracket 12 be of a "v-shape", such that remaining assembly can be affixed to an outside portion of the v-shape. As shown in FIG. 1, the bracket 12 preferably defines in a vertex an angle, "α," of about 90 degrees. The bracket 12 may, however, also have a larger or smaller angle or be of cylindrical or triangular shape or possibly other shapes as would be contemplated by those of ordinary skill in the art and depending on the particular application.

It is also preferred that the bracket 12 be of a rigid, corrosion-resistant material, such as stainless steel. It is contemplated, however, that certain plastics or even wood could be used as a material of the bracket 12. The bracket 12 is preferably rigid enough to handle variable pressure exerted by a user onto the corner bead tool 10. For example, while less pressure may be required against the bracket 12 for applications that are within the user's reach, there may be applications where the user requires an extension pole to apply the corner bead tool 10 to taller corners or any corners that may be out of the normal arm's reach of the user. In such cases, more pressure may be required to be exerted onto the bracket 12 and it is preferred that the bracket be able to withstand such exerted pressure.

Attached to the bracket 12 is a protrusion or ear 14, preferably located at the center of each wall 13 of the bracket 12. When the bracket 12 is of a v-shape, as depicted in FIG. 1, it is contemplated that one protrusion or ear 14 is provided on each side of the bracket 12. One purpose of the ear 14 is to attach an extension device, such as a handle or pole 16, in a number of lengths, for application of the corner bead tool 10 as is known in the art and described more fully below. In addition, it is contemplated that the pole 16 may optionally include a removable extension piece. It is contemplated that any extension device as known by those of ordinary skill, can be utilized in accordance with the present tool 10.

The extension device is pivotally attachable to the bracket 12 via a handle attachment 18 which pivotally engages the protrusions or ears 14. Preferably, a rod end bearing 20 is placed between the ears 14 on the bracket 12, such that an opening 22 in the rod end bearing 20 is aligned with openings 24 in each of the ears. Once aligned, a bracket fastener 26 such as a bolt is placed through the opening 24 of one ear 14, then through the rod end bearing 20 and passes through the second opening 24 of a second ear 14. The openings 24 are preferably circular and are dimensioned to receive the fastener 26. It is contemplated that other sized and shaped openings may be used as would be appreciated by those of ordinary skill. Once passed through the second ear 14, a lock nut 28 is affixed to the bracket fastener 26 to hold the screw in place. It is preferred that the rod end bearing 20 also include at least one spacer bushing 30 to rotatably stabilize the position of the bearing between the ears 14.

Preferably, the rod end bearing 20 includes a threaded portion 32 configured for receiving an extension socket 34, which is preferably has a threaded bore 36 configured for engaging the threaded portion 32 of the rod end bearing 20. The socket 34 is then locked in place on the handle attachment 18 by using a nut 38. The socket is preferably internally threaded to receive the application device 16. It is also contemplated that other forms of attachment may be used for attaching the application device attachment handle 16 and the handle attachment 18, such as, for example, a bayonet lock arrangement or other attachment technology as would be understood by those of ordinary skill in the art.

Referring again to FIG. 1, attached to the elongated bracket 12 are at least two roller assemblies 40. Preferably, at least two pairs of roller assemblies 40, 42 are preferably equidistant from a longitudinal axis of the bracket 12 and are aligned such that the first roller assembly 40 includes a center axis that is perpendicular to a center axis of the second roller assembly 42. It is contemplated that all of the pairs of roller assemblies 40 will have center axes that are perpendicular to the adjacent assemblies 42. Any number of pairs of roller assemblies 40, 42 may be utilized based on the application and the size of the bracket 12.

As an option, at least one additional roller assembly 43 is located between the first and second pairs of roller assemblies. Such additional pairs of roller assemblies prevent "bowing" of longer length brackets 12 once pressure is applied to the corner bead roller.

Figure 2:
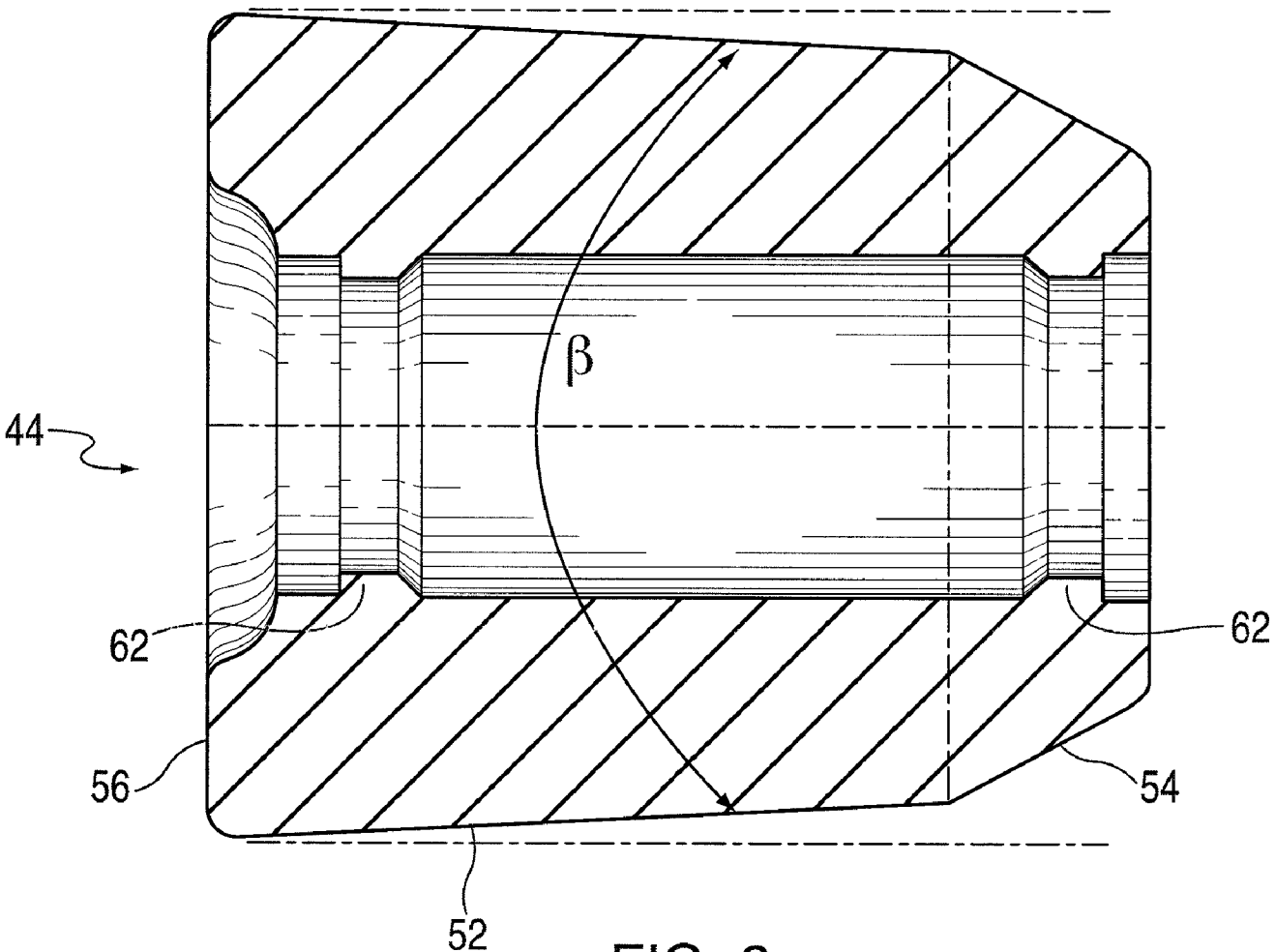
FIG. 2 is a cross-section of an embodiment of a wheel of the present corner bead roller.
Figure 4:
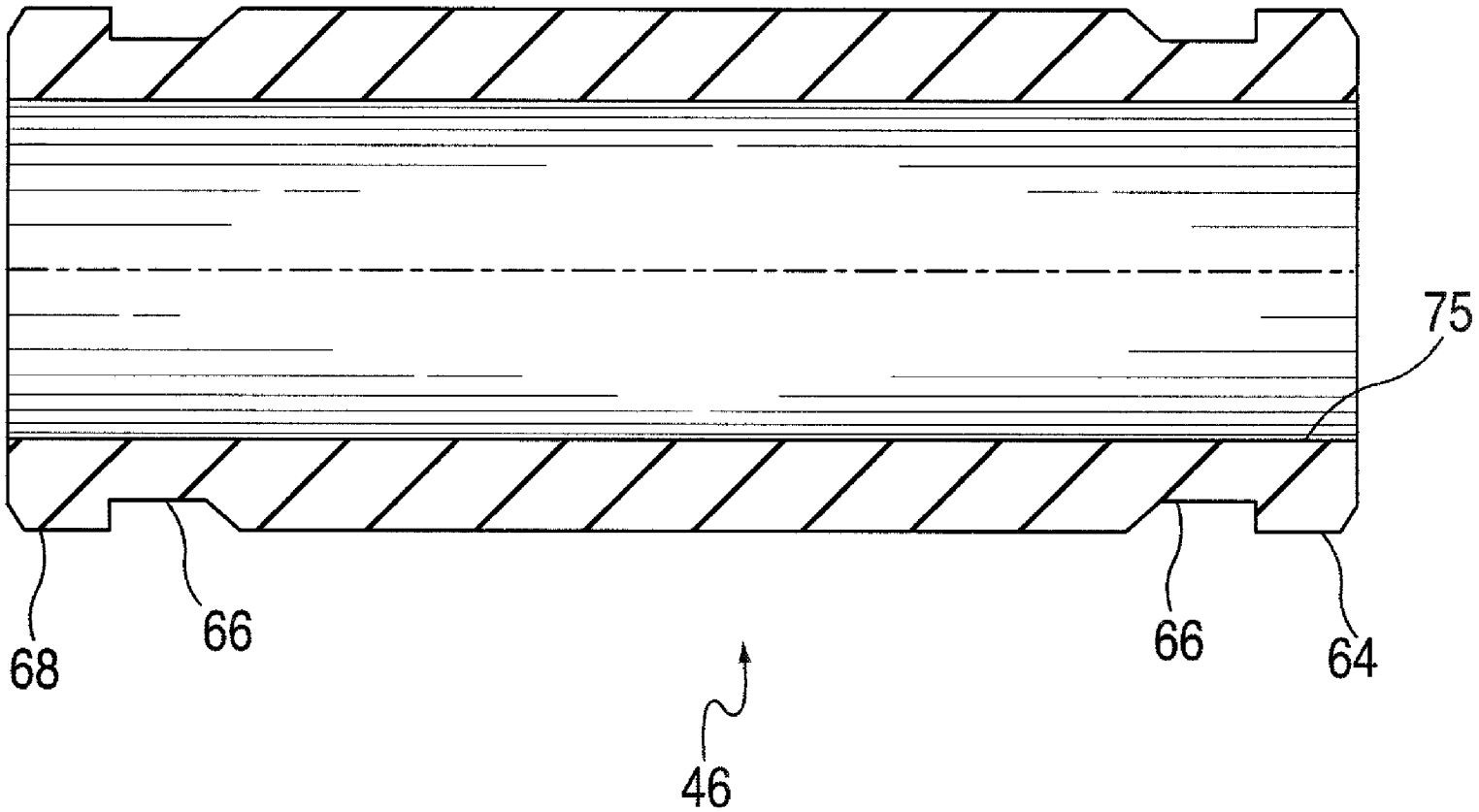
FIG. 4 is a cross-section of an embodiment of a bushing of the present corner bead roller.

Referring to FIGS. 1, 2 and 4, each roller assembly 40, 42 includes a wheel 44 mounted to a bushing 46. The bushing 46 is rotatably mounted to a shaft 48 that is connectable to the elongated bracket 12 and where the shaft 48 is connected to the elongated bracket 12 utilizing a bracket nut 50. Each roller assembly 40 also includes a wheel 44 having a traction portion 52 and a tapered end portion 54 closer to the bracket 12, as well as a sidewall portion 56 and an inner bore 58. The sidewall portion 56 is located at the farthest point on the roller assembly 40 from the bracket 12. The inner bore 58 preferably includes at least one annular rib 62 for positively and matingly engaging the bushing 46. Alternatively, it is contemplated that the inner bore 58 may include recesses for securing to the bushing 46. The sidewall portion 56 is optionally angled inwards and ends where the bushing 46 is inserted into the wheel 44.

Each wheel 44 of each roller assembly 40 preferably includes a dual taper, where the traction portion 52 has less of a taper than does the tapered end portion 54. The traction portion 52 of the wheel 44 is flat as it engages the wallboard for effectively flattening drywall tape onto the surface of the wallboard or other target material. The wheel 44 is preferably tapered such that the traction portion 52 has less of a taper than does the tapered portion 54 closest to the bracket 12. While other angles are contemplated, in a preferred embodiment, each wheel 44 includes a traction portion 52 having a taper of 3°. This taper allows the roller assembly 40 to press firmly against the wallboard and press any excess wallboard compound away from the edge of the corner and facilitate finishing of the wallboard. In addition, the tapered end portion 54 preferably has a taper of greater than 3°.

Each wheel 44 is preferably made of a durable, soft-grip silicone to provide added traction when the tool is rolled upon a wallboard corner, especially when setting tape-on bead is provided. Traditional harder wheels have a tendency to slip when coated with joint compound. Embodiments in accordance with the present invention includes an 84° included angle β, see FIG. 2, straight taper and chamfered top end to match the most popular bead profiles, including outside 90° and bullnose. The wheels 44 may be color-coded by respective corner profiles, for example, black for outside 90°/super-wide and PMS 356 green for bullnose.

Figure 3:
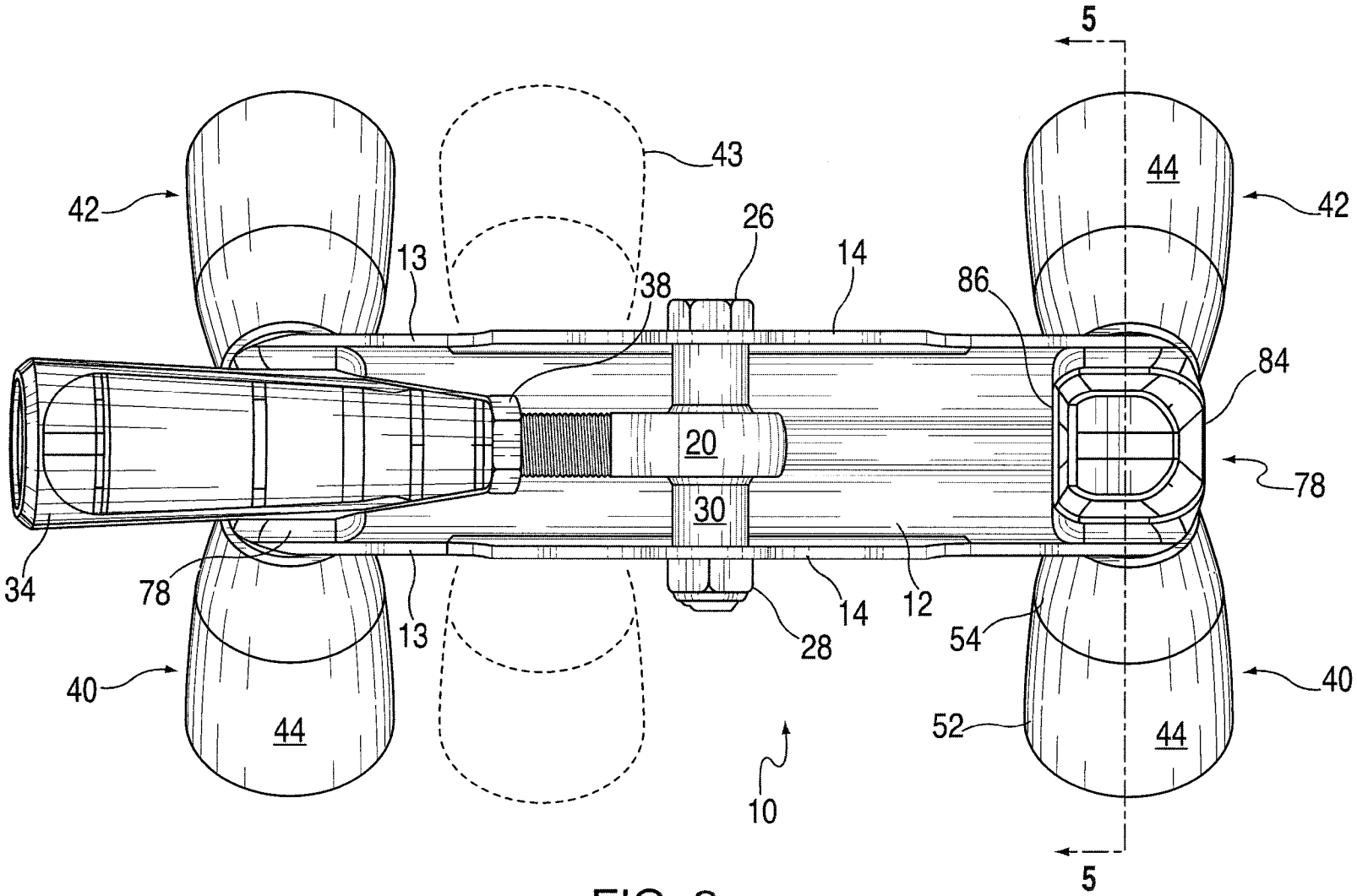
FIG. 3 is a top view of the assembled corner bead roller of FIG. 1.

As shown in FIG. 3, each roller assembly 40 preferably extends and is angled such that the traction portion 52 of each roller assembly 40 extends past the length of the bracket 12. In this way, the amount of wallboard that is pressed by the corner bead tool 10 of the present invention is not limited to where the bracket 12 stops the tool 10 before the bracket 12 hits and causes damage to the wallboard.

As shown in FIGS. 1 and 4, affixed in an inner bore 58 of each wheel 44, each bushing 46 includes an insertion end 64, at least one groove 66 for positively and matingly engaging the annular ribs 62 and a shaft engagement end 68. The ends 64, 68 are reversible since the bushing 46 is symmetrical. It is contemplated that each bushing 46 includes at least one and preferably two grooves 66. The mating tongue-in-groove engagement between the ribs 62 and the grooves 66 prevents the relatively softer silicone on the wheel 44 from shifting relative to the relatively harder plastic bushing 46. Alternatively, it is contemplated that the bushing 46 may include at least one protrusion to engage a recess in the inner bore 58 of the wheel 44. It is also contemplated that any combination of protrusions and grooves may be used to secure engagement between the wheel 44 and the bushing 46. In addition to the above arrangement, chemical adhesive or other supplemental fastening techniques is optionally provided.

Figure 5:
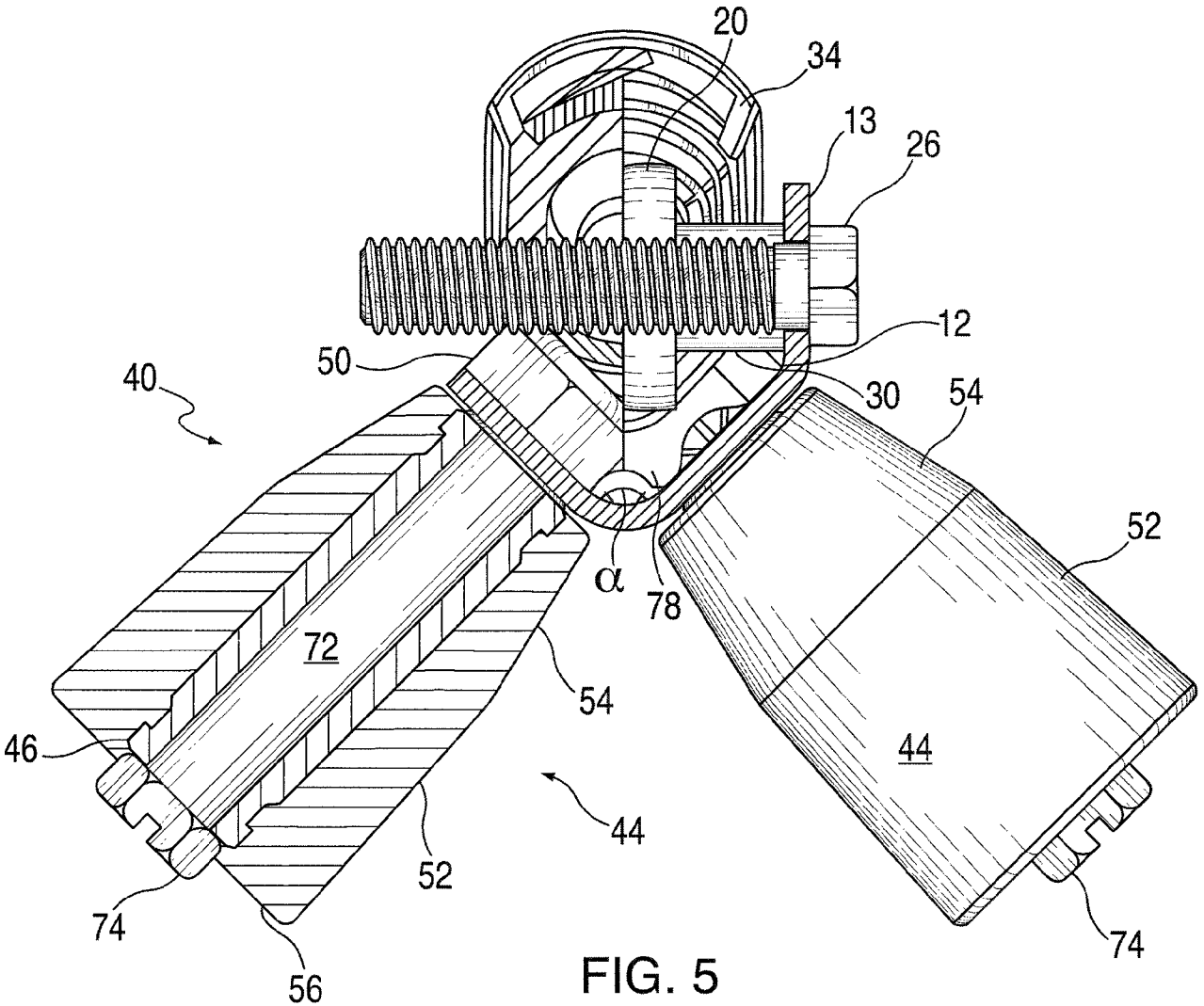
FIG. 5 is a cross-section taken along the line 5-5 in FIG. 3 in the direction generally indicated.

Referring to FIGS. 1 and 5, each shaft 48 includes a threaded tip 70, a shank 72 and a head 74. The threaded tip 70 is inserted into the shaft engagement end 68 of the bushing 46 and pushed through a throughbore 75 in the bushing 46 until the threaded tip 70 passes through an aperture 76 in the elongated bracket 12. The bracket nut 50 is then used to affix the shaft 48 to the bracket 12. Once the shaft 48 is installed, the bushing 46 rotates relative to the shaft 48.

Once secured, the head 74 of the shaft 48 remains at least partially exposed or extends beyond a length of the wheel 44 such that the head 74 is accessible for tightening or loosening by a user of the corner bead roller 10 using a standard wrench.

A bumper 78 is configured for non-rotatably capturing the bracket nut 50. The bumper 78 is located on the opposite side of the walls 13 of the bracket 12 with respect to the roller assemblies 40, 42. A recess 80 is provided on the bumper 78 to non-rotatably capture the bracket nut 50. As shown in FIG. 1, the bumper 78 has two recesses 80, configured to capture each bracket nut 50 from a corresponding pair of roller assemblies 40, 42 mounted perpendicularly onto the bracket 12.

As shown in FIG. 3, the bumper 78 also includes a top surface 82, opposite the bracket nut recesses 80 that face the bracket 12. In addition, the bumper 78 includes a contact end surface 84 and an opposite surface 86. The contact end surface 84 of the bumper 78 functions as a shock absorber and engages the wallboard prior to the bracket 12 hitting the wallboard during application. As shown in FIG. 3, it is contemplated that the contact end surface 84 of the bumper 78 extends beyond the bracket 12 the same amount as traction portion 52 of each of the roller assemblies 40. In this way, the bumper 78 does not impede the pressing action of the roller assemblies.

While a particular embodiment of the present corner bead tool has been described herein, it will be appreciated by those skilled in the art that changes and modifications may be made thereto without departing from the invention in its broader aspects and as set forth in the following claims.

What is claimed is:

1. A wallboard finishing roller comprising:

an elongated bracket having two ends, each end having a first roller assembly and a second roller assembly aligned such that the first roller assembly includes a center axis that is perpendicular to a center axis of the second roller assembly;

each of said first and second roller assemblies including a wheel mounted to a bushing, wherein the bushing is rotatably mounted to a shaft that is connectable to said bracket, and further wherein said shaft is connected to said bracket utilizing a bracket nut; and a bumper associated with said bracket, having a v-shape and being configured for non-rotatably capturing said bracket nut of one of said shafts in said first roller assembly and in said second roller assembly; wherein said bumper includes a contact end surface portion extending beyond the length of said bracket in a direction transverse to both said axes of said shafts of each said roller assembly, such that said contact end surface portion protects a wall from damage associated with the bracket.

2. The wallboard finishing roller of claim 1 wherein the elongated bracket includes at least one ear for connecting an application device.

3. The wallboard finishing roller of claim 2 wherein the application device is at least one of a pole and a handle.

4. A wallboard finishing roller comprising:

an elongated bracket being v-shaped and having two ends, each end having a first roller assembly and a second roller assembly aligned such that the first roller assembly includes a center axis that is perpendicular to a center axis of the second roller assembly;

each roller assembly including a wheel rotatably mounted to said bracket; and a bumper being v-shaped to engage said elongated bracket and including a contact end surface portion extending beyond the length of the bracket in a direction transverse to both axes of said shafts of each said roller assembly such that the contact end surface portion protects a wall from damage associated with the bracket.

5. The wallboard finishing roller of claim 4 wherein the wheel is mounted to the bracket utilizing a shaft that is connectable to the bracket utilizing a bracket nut and the bumper is configured for non-rotatably capturing said bracket nut.

6. A wallboard finishing roller comprising:

an elongated bracket having two ends, each end having a first roller assembly and a second roller assembly aligned such that the first roller assembly includes a center axis that is perpendicular to a center axis of the second roller assembly;

each roller assembly including a wheel mounted to a bushing, wherein the bushing is rotatably mounted to a shaft that is connectable to said bracket; and each wheel of each roller assembly including a dual taper, wherein a traction portion of the end of the roller assembly furthest from the bracket has less of a taper than does the tapered end portion of the roller assembly closest to the bracket.

7. The wallboard finishing roller of claim 6 wherein each wheel includes a traction portion of the wheel furthest from the bracket having a taper of 3°.

8. The wallboard finishing roller of claim 7 wherein each wheel includes a tapered end portion of the wheel closest to the bracket having a taper greater than 3°.

9. The wallboard finishing roller of claim 6 wherein each wheel includes a tapered end portion of the wheel closest to the bracket having a taper greater than 3°.

10. The wallboard finishing roller of claim 6 wherein said shaft includes a threaded fastener with a shaft head and at least a portion of said shaft head extends beyond a length of said wheel such that said shaft head is accessible for tightening or loosening by a user of the wallboard roller.

11. The wallboard finishing roller of claim 6 wherein each wheel is silicone and includes a surface to facilitate traction.

12. The wallboard finishing roller of claim 6 wherein the elongated bracket includes at least one additional roller assembly located between the first and second roller assemblies.

13. A wallboard finishing roller comprising:

an elongated bracket having two ends, each end having a first roller assembly and a second roller assembly aligned such that the first roller assembly includes a center axis that is perpendicular to a center axis of the second roller assembly;

each roller assembly including a wheel mounted to a bushing; wherein the bushing is rotatably mounted to a shaft that is connectable to said bracket and the wheel includes dual tapered surfaces; and wherein each wheel is mounted to each bushing utilizing a tongue and groove connection for preventing each said wheel from shifting relative to said bushing.

14. The wallboard roller of claim 13 wherein the bushing includes at least one groove for receiving a corresponding tongue protrusion on the wheel.

* * * * *